US008608308B2

(12) United States Patent
Ito et al.

(10) Patent No.: US 8,608,308 B2
(45) Date of Patent: Dec. 17, 2013

(54) IMAGE RECORDING DEVICE

(75) Inventors: Tsuyoshi Ito, Nagoya (JP); Kensuke Hirate, Kasugai (JP); Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 324 days.

(21) Appl. No.: 13/072,742

(22) Filed: Mar. 27, 2011

(65) Prior Publication Data

US 2011/0310207 A1 Dec. 22, 2011

(30) Foreign Application Priority Data

Jun. 17, 2010 (JP) ..... 2010-138101

(51) Int. Cl.
*B41J 29/13* (2006.01)
*B41J 2/01* (2006.01)

(52) U.S. Cl.
USPC ..... 347/108; 347/101; 347/104

(58) Field of Classification Search
CPC ..... B41J 11/007; B41J 11/06; B41J 2/2114
USPC ..... 346/145
See application file for complete search history.

(56) References Cited

U.S. PATENT DOCUMENTS 5,280,331 A * 1/1994 Namiki ..... 399/124
6,185,381 B1 2/2001 Nakahara et al.
6,474,884 B2 * 11/2002 Chiu ..... 400/624
7,036,925 B2 * 5/2006 Fujiwara ..... 347/108
7,416,178 B2 * 8/2008 Ito ..... 271/3.14
7,465,109 B2 * 12/2008 Silverbrook et al. ..... 400/88
7,959,149 B2 * 6/2011 Matsumoto ..... 271/162
7,984,909 B2 * 7/2011 Sunohara ..... 271/301
8,277,043 B2 * 10/2012 Hattori et al. ..... 347/109
2005/0073085 A1 * 4/2005 Fukada et al. ..... 271/9.09

(Continued)

FOREIGN PATENT DOCUMENTS

JP H02-112634 U 9/1990
JP H03-249043 A 11/1991

(Continued)

OTHER PUBLICATIONS

Japan Patent Office, Notice of Reasons for Rejection for Japanese Patent Application No. 2010-138101 (counterpart Japanese patent application), mailed Jul. 17, 2012.

(Continued)

*Primary Examiner* — Stephen D Meier
*Assistant Examiner* — Leonard S Liang
(74) *Attorney, Agent, or Firm* — Baker Botts L.L.P.

(57) ABSTRACT

An image recording device comprises a housing, a sheet cassette, a recording unit, and a convey path defining member. The housing has an opening. The sheet cassette is configured to hold therein sheets and configured to be inserted into and removed from the housing through the opening. The recording unit is configured to record an image on a sheet conveyed from the sheet cassette along a convey path. The convey path defining member is configured to pivot, about a pivot shaft supported by the housing, between a guiding position for forming a guide surface that defines a part of the convey path, and an exposing position for exposing the part of the convey path to the opening. The convey path defining member is configured to pivot in response to insertion and removal of the sheet cassette.

16 Claims, 4 Drawing Sheets

(56) References Cited

U.S. PATENT DOCUMENTS

| | | | | |
|---|---|---|---|---|
| 2005/0184442 | A1* | 8/2005 | Kitano | 271/4.03 |
| 2006/0209154 | A1* | 9/2006 | Okabe et al. | 347/104 |
| 2009/0026685 | A1* | 1/2009 | Uchino et al. | 270/18 |
| 2009/0051720 | A1* | 2/2009 | Uchino et al. | 347/16 |
| 2009/0152791 | A1* | 6/2009 | Igarashi | 271/4.08 |
| 2009/0152803 | A1 | 6/2009 | Matsumoto | |
| 2010/0166473 | A1* | 7/2010 | Asada et al. | 399/405 |
| 2010/0207321 | A1* | 8/2010 | Samoto et al. | 271/225 |
| 2011/0001284 | A1* | 1/2011 | Ohtsuki | 271/162 |

FOREIGN PATENT DOCUMENTS

| | | | |
|---|---|---|---|
| JP | H07-206217 | A | 8/1995 |
| JP | 2000-238959 | A | 9/2000 |
| JP | 2002-265091 | A | 9/2002 |
| JP | 2005-031216 | A | 2/2005 |
| JP | 2006-062808 | A | 3/2006 |
| JP | 2007-334197 | A | 12/2007 |

OTHER PUBLICATIONS

Japan Patent Office, Notice of Reasons for Rejection for Japanese Patent Application No. 2010-138101, mailed Apr. 24, 2012.

State Intellectual Property Office of the People'S Republic of China, Notification of the First Office Action for Chinese Patent Application No. 201110085148.6 (related to above-captioned patent application), mailed Aug. 27, 2013.

* cited by examiner

IMAGE RECORDING DEVICE

BACKGROUND OF THE INVENTION

1. Field of the Invention

The present application claims priority from Japanese Patent Application Publication No. JP-2010-138101, which was filed on Jun. 17, 2010, the disclosure of which is incorporated herein by reference in its entirety.

The present invention relates to an image recording device configured to record an image on a sheet, and particularly to an image recording device comprising a mechanism for removing a sheet jammed in a sheet convey path.

2. Description of Related Art

A known image recording device comprises a sheet cassette for holding sheets therein, and a recording unit for recoding an image on a sheet, and a convey path along which the sheet fed from the sheet cassette is conveyed to and from the recording unit. A paper jam occurs for various reasons when a sheet is conveyed along the convey path. In such case, it is required to handle the paper jam quickly.

A known image recording device comprises a paper jam handling mechanism. When a paper jam occurs in a convey path of the image recording device, a sheet cassette is withdrawn, by a user, from a housing of the device and a guide member defining the convey path is operated by the user to open the convey path. This allows the user to eliminate the jammed sheet through the opened convey path.

However, after the jam handling is completed, the user is required to operate the guide member to restore the convey path to the original state. Thus, the jam handling may be burdensome for the user.

SUMMARY OF THE INVENTION

Therefore, an object of the invention is to provide an image recording device comprising a mechanism for readily restoring a convey path from an open state for paper jam handling to the original state. A technical advantage of the invention is that the convey path is restored to the original state after paper jam handling only by insertion of a sheet cassette into a housing of the device.

According to an embodiment of the invention, an image recording device comprises a housing, a sheet cassette, a recording unit, and a convey path defining member. The housing has an opening. The sheet cassette is configured to hold therein sheets and configured to be inserted into and removed from the housing through the opening. The recording unit is configured to record an image on a sheet conveyed from the sheet cassette along a convey path. The convey path defining member is configured to pivot, about a pivot shaft supported by the housing, between a guiding position for forming a guide surface that defines a part of the convey path, and an exposing position for exposing the part of the convey path to the opening. The convey path defining member is configured to pivot in response to insertion and removal of the sheet cassette.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-4B, like numerals being used for like corresponding parts in the various drawings.

In the following description, the expressions "front", "rear", "upper", "lower", "right", and "left" are used to define the various parts when the multi-function device 10 is disposed in an orientation in which it is intended to be used.

Figure 1:
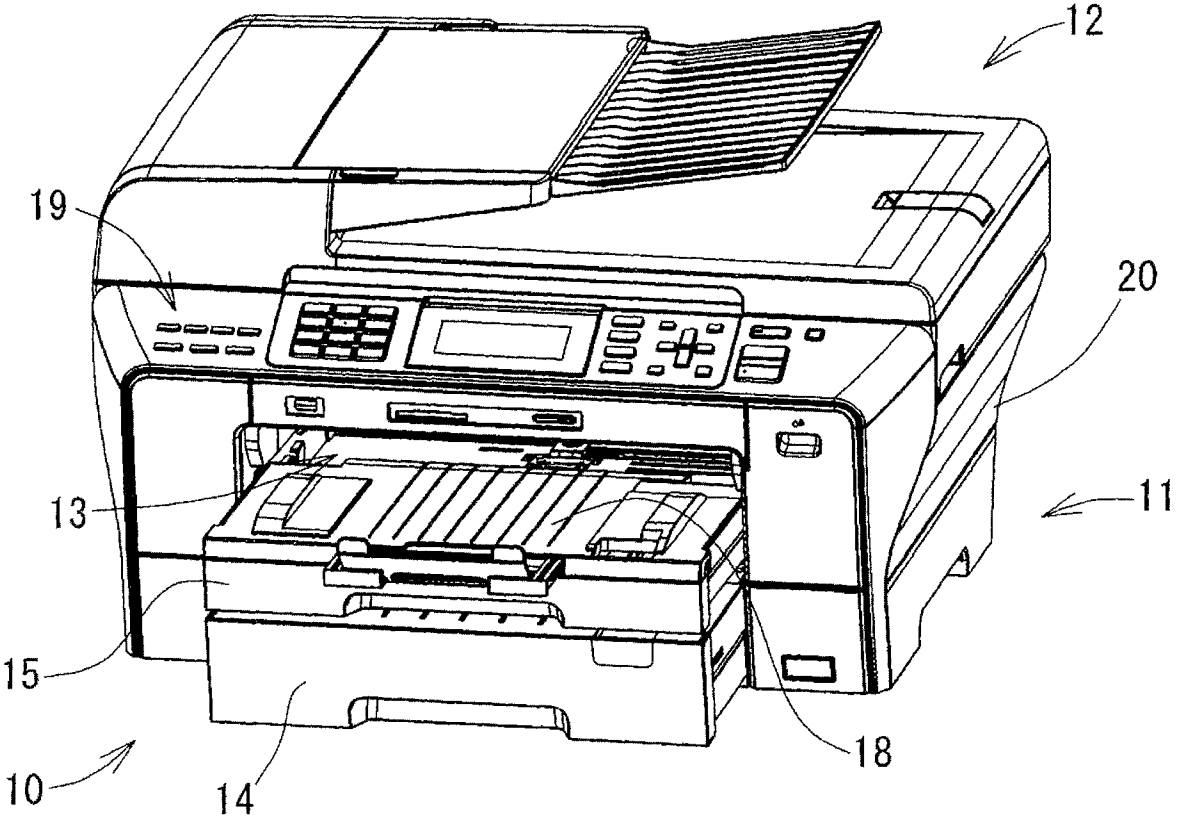
FIG. 1 is an external perspective view of a multi-function device according to an embodiment of the invention.

As shown in FIG. 1, the multi-function device 10 comprises an image recording device, e.g., a printer 11, and a scanner 12. The multi-function device 10 has a printing function, a scanning function, a copying function, and a facsimile function. The multi-function device 10 need not necessarily have a scanner 12. An image recording device according to the present invention may be a single-function printer that does not have a scanning function and a copying function. Therefore, the description of the detailed configuration of the scanner 12 will be omitted.

In the lower part of the multi-function device 10, the printer 11 is located. An opening 13 is formed on a front side of the primer 11. Sheet cassettes 14 and 15 are inserted into the printer 11 through the opening 13. The sheet cassettes 14 and 15 are configured to hold sheets 16 having a predetermined rectangular shape (see FIG. 2). The sheets 16 are selectively fed from the sheet cassette 14 or 15 into the printer 11. A sheet 16 fed to the printer 11 is discharged onto an upper surface 18 of the sheet cassette 15 after an image is recorded thereon by a recording unit 17 (see FIG. 2). The upper surface 18 functions as an output tray 18. Although two sheet cassettes 14 and 15 are provided in this embodiment, the sheet cassette 14 may be omitted.

The multi-function device 10 is used mainly in a state where it is connected with an external information device (not shown) such as a computer. The printer 11 records an image on a sheet 16 based on print data received from the external information device or image data of a document read in the scanner 12. In the upper part of the front of the multi-function device 10, an operation panel 19 is provided. The operation panel 19 has a display that displays various information and input keys that receive input of information. The multi-function device 10 operates based on instructions input through the operation panel 19 or instructions transmitted from the external information device through a printer driver or a scanner driver.

Figure 2:
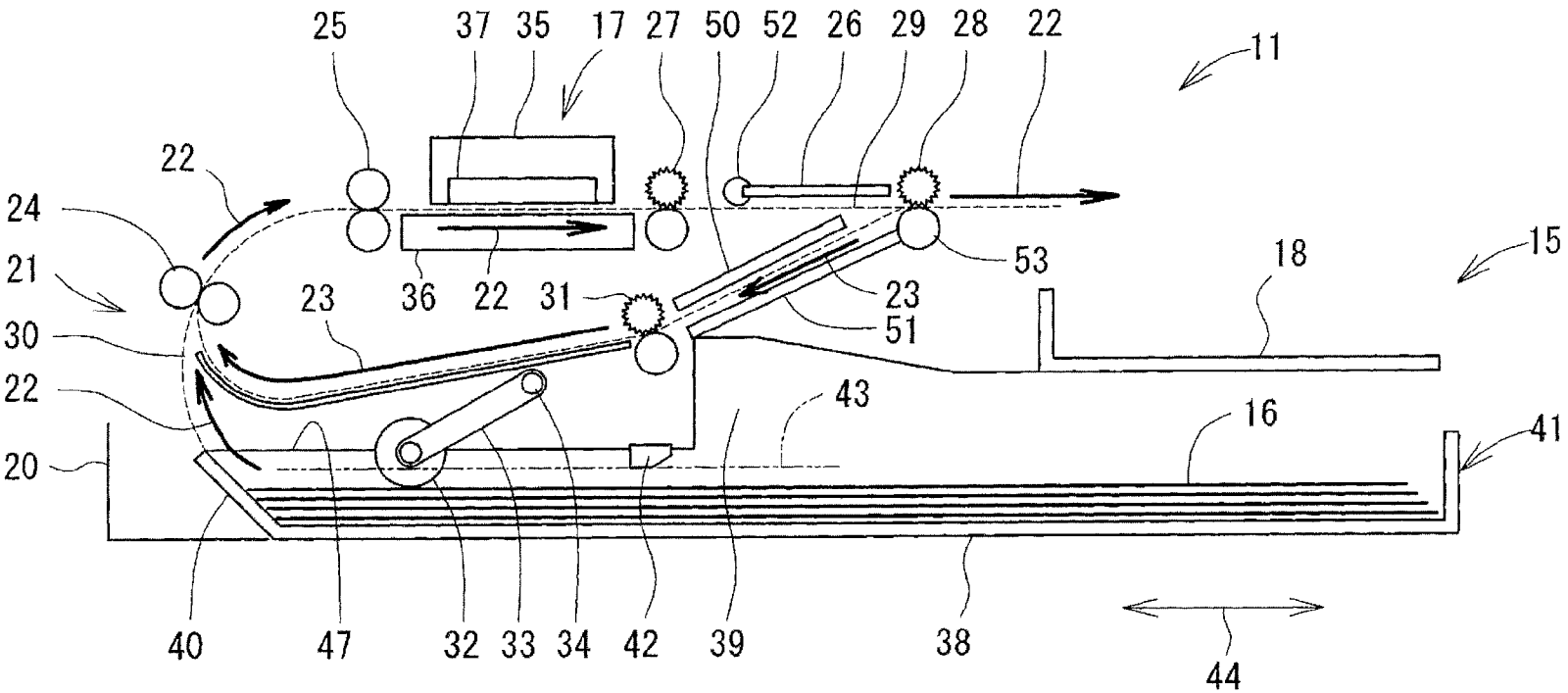
FIG. 2 is a schematic view showing a structure of a printer of the multi-function device.
Figure 3:
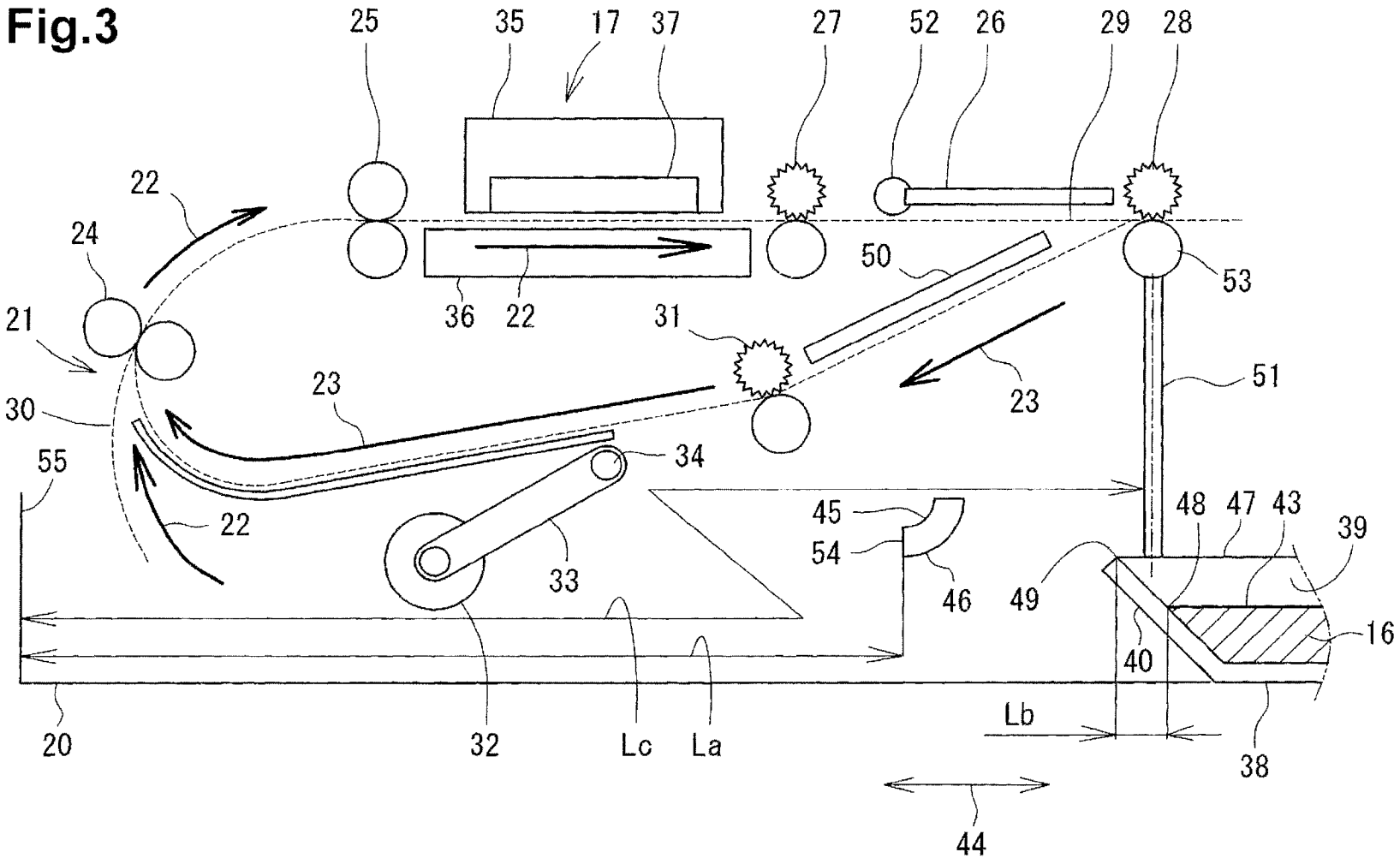
FIG. 3 is a schematic view showing the printer.

With reference to FIGS. 2 and 3, the configuration of the printer 11 will be described. For simplicity of description, the sheet cassette 14 is omitted from these figures.

As shown in FIG. 2, the printer 11 has a housing 20, in which the sheet cassette 15, the recording unit 17, and other functional components are disposed. A sheet 16 fed from the sheet cassette 15 is conveyed along a convey path 21 formed in the housing 20. The convey path 21 includes a first path 22 and a second path 23 to be described later. With this structure, the multi-function device 10 can reverse the sheet 16 and record images on both surfaces thereof. Specifically, a sheet 16 fed from the sheet cassette 15 is conveyed, with a first edge (e.g., a leading edge) forward, along the first path 22, and an image is recorded on a first surface (e.g., a front surface) of the sheet 16. If an image is to be recorded also on a second surface (e.g., a back surface) of the sheet 16, the sheet 16 is switched back, with a second edge (e.g., a trailing edge) forward, from the first path 22 to the second path 23 and is returned to the first path 22. Thus, the sheet 16 is reversed, and an image is recorded on the back surface of the sheet 16 by the recording unit 17.

The first path 22 extends from the sheet cassette 15 to the output tray 18. An intermediate roller pair 24, a paper feed roller pair 25, a recording unit 17, an exit roller pair 27, and a switchback roller pair 28 are disposed along the first path 22 from the sheet cassette 15 to the output tray 18, in this order from the upstream side in a first convey direction.

The first path 22 forms a so-called U-turn path that makes a U-turn while curving upward from the sheet cassette 15. The intermediate roller pair 24 is disposed at a position where the first path 22 curves. The paper feed roller pair 25 is disposed at a position where the curve of the first path 22 ends. After curving and making a U-turn, the first path 22 forms a so-called straight path. In this straight path, the recording unit 17, the exit roller pair 27, and the switchback roller pair 28 are disposed. The intermediate roller pair 24, the paper feed roller pair 25, and the exit roller pair 27 convey a sheet 16 along the first path 22 in the first convey direction. The switchback roller pair 28 is disposed downstream, in the first convey direction, of a recording unit 17. Specifically, the switchback roller pair 28 is disposed downstream, in the first convey direction, of a branch portion formed between the first path 22 and the second path 23. The switchback roller pair 28 rotates in the forward or reverse direction and thereby conveys the sheet 16 conveyed along the first path 22 selectively in the first convey direction or a second convey direction. The second convey direction is substantially opposite to the first convey direction.

A switchback flap 26 is disposed, along the first path 22, between the exit roller pair 27 and the switchback roller pair 28. The switchback flap 26 is pivotably supported by a pivot shaft 52. The pivot shaft 52 is disposed closer to the exit roller pair 27 than to the switchback roller pair 28. That is, the pivot shaft 52 is disposed upstream, in the first convey direction, of a downstream position 29 (branch portion) located between the exit roller pair 27 and the switchback roller pair 28. Therefore, when the switchback flap 26 is parallel to the first path 22 as shown in FIG. 2, the sheet 16 is guided along the first path 22 in the first convey direction. When the sheet 16 is to be switched back, the switchback flap 26 pivots about the pivot shaft downward (clockwise in the figure) and directs the second edge of the sheet 16 toward the second path 23.

The second path 23 branches from the first path 22 and merges again with the first path 22. Specifically, the second path 23 extends from the downstream position 29 to an upstream position 30 between the sheet cassette 15 and the intermediate roller pair 24. At the downstream position 29, the first path 22 bifurcates into the second path 23. A duplex roller pair 31 is disposed along the second path 23 and conveys sheet 16 from the downstream position 29 (branch portion) toward the upstream position 30. The duplex roller pair 31 functions as return rollers for returning the sheet 16 having an image recorded on the first surface (front surface) thereof to the upstream position 30.

Convey path defining members, e.g., guides 50 and 51 are disposed along the second path 23. In this embodiment, the second path 23 extends, as shown in FIG. 2, from the downstream position 29 (branch portion) obliquely downward. The guide 50 is disposed between the switchback roller pair 28 and the duplex roller pair 31 and forms an upper guide surface defining a part of the second path 23.

The guide 51 is disposed between the switchback roller pair 28 and the duplex roller pair 31 to oppose the guide 50, and forms a lower guide surface defining a part of the second path 23. The lower guide surface formed by the guide 51 faces up. The guide 51 is pivotably supported by a shaft 53. The guide 51 suspends from the shaft 53 and is configured to hang down due to its own weight. In this embodiment, the shaft 53 is a rotating shaft of one of the switchback roller pair 28. That is to say, the shaft 53 is commonly used for rotating the switchback roller pair 28 and for supporting the guide 51. However, the shaft for supporting the guide 51 may be provided separately from the rotating shaft.

When the guide pivots about the shaft 53 clockwise, the guide 51 forms a lower guide surface defining a part of the second path 23, as shown in FIG. 2. When the guide 51 pivots about the shaft 53 counterclockwise, the guide 51 opens the part of the second path 23 as shown in FIG. 3. The guide 51 is configured to pivot counterclockwise further such that a free end of the guide 51 is directed in a direction in which the sheet cassette 15 is removed (directed to the right along the direction of arrow 44). In this position, the free end of the guide 51 is directed toward the opening 13, and exposes the part of the second path 23 to the opening 13.

In this embodiment, the guide 51 is configured to pivot about the shall 53 due to its own weight. However, the guide 51 may be urged so as to pivot about the shaft 53 counterclockwise. Although the structure of urging means is arbitrary, typically a torsion coil spring may be placed between the shaft 53 and the guide 51.

A feed roller 32 is disposed above the sheet cassette 15. The feed roller 32 is rotatably supported at the tip of an arm 33. The base end of the arm 33 is configured to pivot about the shaft 34, thereby bringing the feed roller 32 into and out of contact with the sheet cassette 15. The arm 33 is caused to pivot by the weight of the feed roller 32 toward the sheet cassette 15. Thus, the feed roller 32 comes into contact with the uppermost one of a plurality of sheets 16 stacked in the sheet cassette 15.

The recording unit 17 includes a carriage 35 disposed above the first path 22, and a platen 36 disposed below the first path 22. The carriage 35 carries an inkjet recording head 37. The inkjet recording head 37 is disposed to oppose the platen 36. When the carriage 35 reciprocates in the direction perpendicular to the first convey direction (in the direction perpendicular to a sheet plane of FIG. 2), the inkjet recording head 37 selectively ejects ink droplets toward the platen 36. The ejected ink droplets land on the sheet 16 being conveyed in the first convey direction on the platen 36. By alternately repeating the conveyance of the sheet 16 and the reciprocation of the carriage 35, a desired image is recorded on the sheet 16.

The sheet cassette 15 is configured to hold a plurality of sheets 16. The sheet cassette 15 is shaped like a container and has an opening to be positioned on a rear side of the multifunction device 10 (on the left side in FIG. 2). The sheets 16 are stacked in the internal space of the sheet cassette 15. The sheet cassette 15 is configured to house various sizes of sheets 16, for example, A3-size sheets, A4-size sheets, B5-size sheets, and postcard-size sheets. The upper surface 18 of the sheet cassette 15 is positioned on a front side of the multifunction device 10 (on the right side in FIG. 2) and functions as an output tray 18 as described above.

The sheet cassette 15 is shaped like a tray and includes a main body 41 having a bottom 38, side walls 39, and a rear wall 40, and limiting members 42 that limit the maximum number 43 of sheets 16 (shown by the two-dot-one-dash line in FIG. 2) held in the main body 41. The bottom 38 is a rectangular flat plate, and sheets 16 are placed on the bottom 38. The side walls 39 stand upright from side edges of the bottom 38. The rear wall 40 extends from a rear edge of the bottom portion 38 and is joined to the side walls 39. As shown in FIG. 2, the rear wall 40 is inclined with respect to the bottom 38, in a direction in which the sheet 16 is conveyed. Therefore, the sheet 16 is fed from the sheet cassette 15 by the feed roller 32 to the first path 22 while the first edge (leading edge) of the sheet 16 is guided upward by the inner surface of the rear wall 40. The limiting members 42 are attached to the side walls 39. When the maximum number 43 of sheets 16 are loaded, the limiting members 42 contacts the uppermost one of the sheets 16. Therefore, the sheets cannot be loaded in the sheet cassette 15 beyond the maximum number of sheets.

The sheet cassette 15 is inserted into and removed from the housing 20 along the direction of arrow 44. The sheet cassette 15 is inserted into the housing 20 in the same direction as a direction in which the sheet is fed from the sheet cassette 15. The insertion direction of the sheet cassette 15 is perpendicular to a direction in which the shaft 53 for supporting the guide 51 extends. FIG. 2 shows a state where the sheet cassette 15 is fully inserted into the housing 20. FIG. 3 shows a state where the sheet cassette 15 is removed from the housing 20. As shown in FIG. 3, assist members 45 for guiding the insertion and removal of the sheet cassette 15 are fixed to the housing 20. Each of the assist members 45 has substantially an L-shape as shown in FIG. 3 and comes into contact with the side wall 39 of the sheet cassette 15. Specifically, each of the assist members 45 has a contacting surface 46 that comes into contact with a corresponding one of the side walls 39. The contacting surfaces 46 come into contact with the upper surfaces 47 of the side walls 39 from above during insertion and removal of the sheet cassette 15. The external shape of the assist members 45 may be changed arbitrarily as long as the assist members 45 have surfaces (contacting surfaces 46) that come into contact with the upper surfaces 47 of the side walls 39 from above.

In this embodiment, each of the assist members 45 is disposed at a predetermined position in the housing 20. A rear end 54 of the assist member 45 (a lower end of the contacting surface 46) is away by a distance La, in the direction of arrow 44, from a rear reference position, e.g., a rear wall surface 55 of the housing 20. The shaft 53 that supports the guide 51 is away by a distance Lc, in the direction of arrow 44, from the rear wall surface 55. In addition, because the rear wall 40 of the sheet cassette 15 is inclined as described above, a leading edge 48 of the uppermost sheet 16 is shifted, in the direction of arrow 44, from the upper end 49 of the rear wall 40 when sheets 16 are held in the sheet cassette 15. When the maximum umber 43 of sheets 16 is held in the sheet cassette 15, the leading edge 48 of the uppermost sheet 16 is shifted by a distance Lb from the upper end 49 of the rear wall 40 in the insertion/removal direction of the sheet cassette 15 (in the direction of arrow 44). In this embodiment, the distances La, Lb, and Lc have the following relationship: La>Lc−Lb. A technical advantage of this relationship will be described later.

As shown in FIGS. 2 to 4, when the sheet cassette 15 is removed from the housing 20 (see FIG. 3), the sheet cassette 15 is brought out of contact with the guide 51. Thus, the guide 51 pivots downward about the shaft 53, and a part of the second path 23 is opened. When the sheet cassette 15 is inserted into the housing 20, a predetermined portion of the sheet cassette 15 comes into contact with the guide 51, and the guide 51 is pushed by the sheet cassette 15 and pivots upward about the shaft 53. Thus, the guide 51 moves from a downward position for opening the second path to a guiding position for closing the second path and defining the second path 23.

Figure 4A:
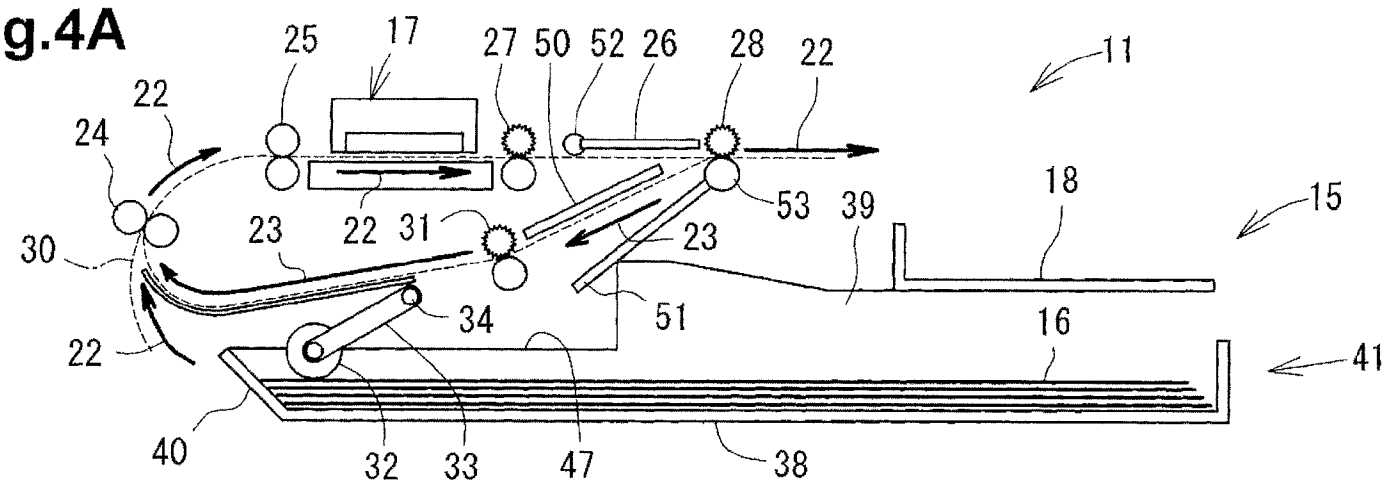
FIGS. 4A and 4B are schematic views showing a sheet cassette being inserted and removed from a housing of the printer.
Figure 4B:
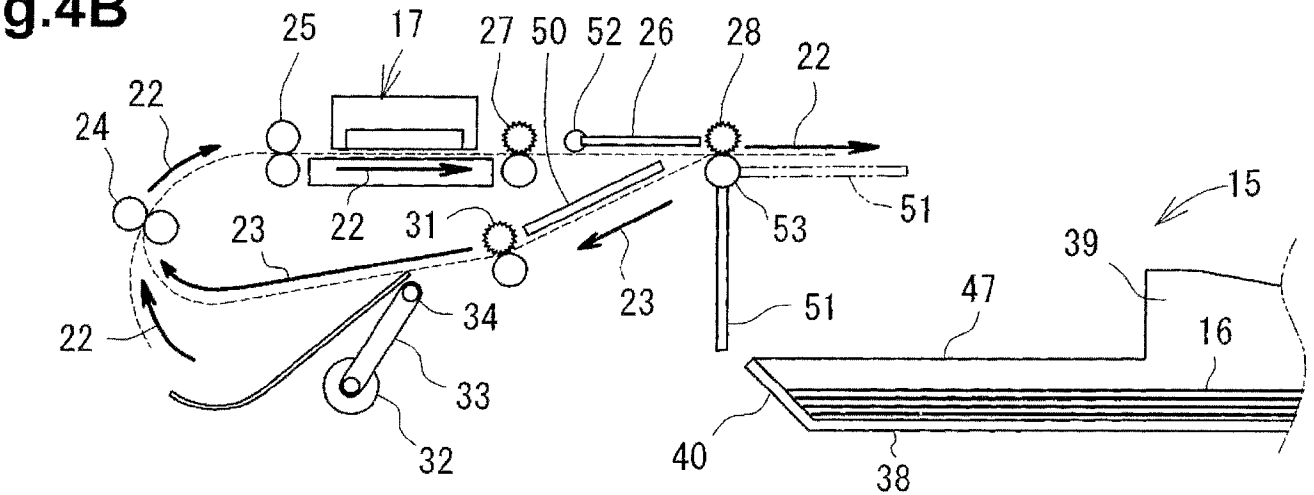

That is to say, the guide 51 forms a lower guide surface defining a part of the second path 23, and opens and closes the second path 23 in response to insertion and removal of the sheet cassette 15. As shown in FIG. 4B, in a state where the sheet cassette 15 is removed, the guide 51 is configured to pivot further such that the free end of the guide 51 is directed in the removal direction of the sheet cassette 15 (to the right along the direction of arrow 44). That is, the guide 51 is configured to pivot to an exposing position which is shown by the two-dot-one-dash line FIG. 4B. The guide 51 located in the exposing position exposes the part of the second path 23 to the opening 13.

Therefore, when the sheet cassette 15 is removed through the opening 13 (see FIG. 1) of the housing 20, for example, in order to clear a paper jam, the guide 51 pivots about the shaft 53 to the downward position. The guide 51 opens a part of the second path 23 and comes into a substantially hanging state. The user may insert hand through the opening 13 and pivot the guide 51 toward the front of the multi-function device 10 (see FIG. 4B). Thus, the guide 51 is brought from the downward position to the exposing position, and the second path 23 is exposed to the opening 13 and is visible through the opening 13. This allows the user to remove the sheet 16 in the second path 23 from the front of the multi-function device 10 through the opening 13.

After the sheet 16 is removed, the user may insert the sheet cassette 15 into the housing 20. As shown in FIG. 4A, the guide 51 is returned to the guiding position just by inserting the sheet cassette 15 into the housing 20. The guide 51 pivots upward about the shaft 23 while being pushed by the sheet cassette 15 inserted into the housing 20, and forms the lower guide surface defining a part of the second path 23.

In the multi-function device 10, the second path 23 is restored from an open state, without the use of a specific mechanism, just by inserting the sheet cassette 15 into the housing 20 after clearing a paper jam. Therefore, the user can readily clear a paper jam.

In this embodiment, when the sheet cassette 15 is removed from the housing 20, the guide 51 pivots to the downward position only by its own weight and opens the second path 23. The mechanism for moving the guide 51 to the downward position is simple.

The guide 51 is positioned into the guiding position while being pushed up and supported from below by the sheet cassette 15 inserted into the housing 20. Because the sheet cassette 15 positions the guide 51 so as to define the second path 23, there is no need to provide a device for driving the guide 51.

In this embodiment, the distances La, Lb, and Lc have the following relationship: La>Lc−Lb. Therefore, even if the sheet cassette 15 is incompletely inserted, the guide 51 in a hanging state is not interfered or damaged by the sheets 16 held in the sheet cassette 15. When the upper end 49 of the rear wall 40 of the sheet cassette 15 is located outside the guide 51 (on the front side of the guide 51), that is to say, on the right side along the direction of arrow 44 (FIG. 4B), the sheet cassette 15 does not come into contact with the guide 51. Even if the user accidentally brings the inner surface of the rear wall 40 of the sheet cassette 15 into contact with the guide 51 when the guide 51 is located between the upper end 49 of the rear wall 40 and the leading edge 48 of the uppermost sheet 16 in the sheet cassette 15, the guide 51 does not interfere with the sheets 16 because the rear wall 40 is inclined and therefore the guide 51 pivots along the inclined inner surface of the rear wall 40. Even if the sheet cassette 15 is slightly pulled out from the housing 20, the sheets held in the sheet cassette 15 does not interfere with the guide 51 as long as the sheet cassette 15 is engaged with the assist members 45. The assist members 45 prevent the sheet cassette 15 from moving in the vertical direction.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. An image recording device comprising:

a housing having an opening;

a sheet cassette configured to hold therein sheets and configured to be inserted into and removed from the housing through the opening;

a recording unit configured to record an image on a sheet conveyed from the sheet cassette along a convey path; and a convey path defining member configured to pivot, about a pivot shaft supported by the housing, between a guiding position for forming a guide surface that defines a part of the convey path, and an exposing position for exposing the part of the convey path to the opening, wherein the convey path defining member is configured to pivot in response to insertion and removal of the sheet cassette, wherein a free end of the convey path defining member is directed toward the opening when the convey path defining member is in the exposing position, wherein when the sheet cassette is removed from the housing, the convey path defining member is configured to pivot to a downward position which is between the guiding position and the exposing position and in which the convey path defining member hangs down from the pivot shaft, and wherein the convey path defining member is configured to pivot to the guiding position by being pushed by the sheet cassette when the sheet cassette is inserted into the housing.

2. The image recording device according to claim 1, wherein the convey path defining member is configured to pivot to the downward position by its own weight when the sheet cassette is removed from the housing.

3. The image recording device according to claim 1, wherein when the sheet cassette is inserted into the housing, the sheet cassette is configured to support, from below, the convey path defining member and to position the convey path defining member to the guiding position.

4. The image recording device according to claim 1, wherein the convey path is formed by a first path along which the sheet is conveyed from the sheet cassette to the recording unit in a convey direction, and a second path along which the sheet having the image recorded thereon by the recording unit is returned to an upstream portion, in the convey direction, of the recording unit, and wherein the guide surface formed by the convey path defining member faces upward and defines a part of the second path.

5. The image recording device according to claim 4, further comprising a switchback roller configured to rotate selectively in forward and reverse directions and to convey the sheet from the first path to the second path, wherein the pivot shaft of the convey path defining member serves as a rotating shaft of the switchback roller.

6. The image recording device according to claim 1, wherein the pivot shaft of the convey path defining member extends in a direction perpendicular to a direction in which the sheet cassette is inserted into and removed from the housing.

7. The image recording device according to claim 1, wherein the sheet is fed from the sheet cassette in a feed direction, and the sheet cassette is configured to be inserted into the housing in a same direction as the feed direction.

8. The image recording device according to claim 1, further comprising:

a switchback roller configured to rotate selectively in forward and reverse directions and to convey the sheet having the image recorded thereon by the recording unit; and a return roller configured to return, toward the recording unit, the sheet conveyed by the switchback roller, wherein the convey path defining member located in the guiding position extends between the switchback roller and the return roller.

9. An image recording device comprising:

a housing having an opening;

a sheet cassette configured to hold therein sheets and configured to be inserted into and removed from the housing through the opening;

a recording unit configured to record an image on a sheet conveyed from the sheet cassette along a convey path; and a convey path defining member configured to pivot, about a pivot shaft supported by the housing, between a guiding position for forming a guide surface that defines a part of the convey path, and an exposing position for exposing the part of the convey path to the opening, wherein the convey path defining member is configured to pivot in response to insertion and removal of the sheet cassette, wherein the opening is formed on a front side of the housing, wherein the sheet cassette comprises a bottom for holding thereon the sheets, side walls standing from the bottom, a rear wall standing obliquely from the bottom, and a limiting member configured to limit a maximum number of sheets to be held in the sheet cassette, wherein the housing comprises an assist member configured to contact, from above, the side walls of the sheet cassette and to assist insertion and removal of the sheet cassette, and wherein a rear end of the assist member is away by a distance La from a rear reference position of the housing in an insertion and removal direction of the sheet cassette, and a relationship $La>Lc-Lb$ is satisfied where a distance in the insertion and removal direction between a leading edge of an uppermost one of the maximum number of sheets held in the sheet cassette and an upper end of the rear wall is Lb, and a distance in the insertion and removal direction between the pivot shaft and the rear reference position of the housing is Lc.

10. The image recording device according to claim 9, wherein a free end of the convey path defining member is configured to be directed toward the opening when the convey path defining member is in the exposing position.

11. The image recording device according to claim 9, wherein when the sheet cassette is removed from the housing, the convey path defining member is configured to pivot to a downward position which is between the guiding position and the exposing position and in which the convey path defining member hangs down from the pivot shaft, and wherein the convey path defining member is configured to pivot to the guiding position by being pushed by the sheet cassette when the sheet cassette is inserted into the housing.

12. The image recording device according to claim 9, wherein when the sheet cassette is inserted into the housing, the sheet cassette is configured to support, from below, the convey path defining member and to position the convey path defining member to the guiding position.

13. The image recording device according to claim 9, wherein the convey path is formed by a first path along which the sheet is conveyed from the sheet cassette to the recording unit in a convey direction, and a second path along which the sheet having the image recorded thereon by the recording unit is returned to an upstream portion, in the convey direction, of the recording unit, and wherein the guide surface formed by the convey path defining member faces upward and defines a part of the second path.

14. The image recording device according to claim 13, further comprising a switchback roller configured to rotate selectively in forward and reverse directions and to convey the sheet from the first path to the second path, wherein the pivot shaft of the convey path defining member serves as a rotating shaft of the switchback roller.

15. The image recording device according to claim 9, wherein the sheet is fed from the sheet cassette in a feed direction, and the sheet cassette is configured to be inserted into the housing in a same direction as the feed direction.

16. The image recording device according to claim 9, further comprising:

a switchback roller configured to rotate selectively in forward and reverse directions and to convey the sheet having the image recorded thereon by the recording unit; and a return roller configured to return, toward the recording unit, the sheet conveyed by the switchback roller, wherein the convey path defining member located in the guiding position extends between the switchback roller and the return roller.

* * * * *